US005374155A

United States Patent [19]

Van Baale et al.

[11] Patent Number: 5,374,155

[45] Date of Patent: Dec. 20, 1994

[54] STOWABLE LOAD STABILIZER FOR FORKLIFT MAST

[76] Inventors: H. Kirk Van Baale, 7937 Madison, Kansas City, Mo. 64114; Wesley C. Hatfield, 2920 N. 74th, Kansas City, Kans. 66106

[21] Appl. No.: 100,213

[22] Filed: Aug. 2, 1993

[51] Int. Cl.[5] ..... B66F 9/18

[52] U.S. Cl. ..... 414/607; 414/622

[58] Field of Search ..... 414/607, 622, 618, 619; 410/135, 143, 144, 145, 146, 147, 148, 149

[56] References Cited

U.S. PATENT DOCUMENTS

| | | | |
|---|---|---|---|
| 2,319,456 | 5/1943 | Hazen | 414/607 |
| 2,660,327 | 11/1953 | Blatz | 414/607 |
| 3,115,262 | 12/1963 | Avery | 414/622 |
| 3,200,978 | 8/1965 | Brady et al. | 414/607 |
| 3,272,364 | 9/1966 | Mindrum et al. | 414/622 |
| 3,773,202 | 11/1973 | Dutra, Jr. . | |
| 3,797,684 | 3/1974 | Brandt | 414/607 |
| 4,116,349 | 9/1978 | Durham . | |
| 4,136,793 | 1/1979 | Dutra, Jr. . | |
| 4,198,188 | 4/1980 | Perkins . | |
| 4,354,795 | 10/1982 | Dutra, Jr. . | |
| 4,549,845 | 10/1985 | Ramsey, Jr. . | |
| 4,659,277 | 4/1987 | Widener | 414/607 |
| 4,850,789 | 7/1989 | Zimmerman | 414/607 |
| 4,940,381 | 7/1990 | Rysewyk . | |
| 4,941,798 | 7/1990 | Meier . | |
| 5,026,245 | 6/1991 | Sabo . | |

*Primary Examiner*—David A. Bucci
*Assistant Examiner*—Thomas J. Brahan
*Attorney, Agent, or Firm*—Litman, McMahon & Brown

[57] ABSTRACT

A load stabilizer apparatus for a forklift mast includes a mounting member attached to a cross member of a lift carriage of the mast, a stabilizer frame member hingedly connected to the mounting member and pivotable between a stabilizing position and a stowed position, a pair of load stabilizer arms extending from the stabilizer frame member, and load engaging pads mounted on the outer ends of the stabilizer arms. The apparatus is retained in the stabilizing position by a latch pawl which releasably engages an edge of the stabilizer frame member. The apparatus includes a swing control bracket which engages a lower surface of the lift carriage cross member to prevent the apparatus from striking components of the lift carriage when the apparatus is released from the stabilizing position.

13 Claims, 1 Drawing Sheet

STOWABLE LOAD STABILIZER FOR FORKLIFT MAST

BACKGROUND OF THE INVENTION

Forklift trucks having raisable forks are often employed to lift and move articles too heavy or otherwise unsuitable for manual handling. Such vehicles have lift masts mounted for lifting the load so that the load may be transported to another location and deposited. The lift masts typically have a carriage which is mounted on uprights of the lift mast and selectively positionable at a desired height. Usually, a pair of spaced apart forks are mounted on the carriage and are positioned beneath the load for lifting it.

In situations where the load to be lifted is relatively tall or tall and top-heavy, the potential for inadvertent tipping under the dynamics of vehicle operation exists. Loads which are relatively light in weight also tend to have a higher incidence of inadvertent movement on the forks caused by the vehicle dynamics. In order to prevent potentially very expensive damage to loads caused by tipping over during movement by forklift trucks, such movement must often be carried out at a much slower rate than would otherwise be necessary. However, such slower movement decreases the handling productivity of such loads which, consequently, increases the cost of labor in handling such articles.

In order to avoid the expense of repair or replacement of articles damaged during handling by forklift trucks and to increase the handling productivity of such articles, various types of load stabilizers have been devised for forklift trucks. Many of the load stabilizers are side clamping type devices including a pair of side clamps to engage the lateral sides of the article to be carried or top clamping devices which engage the tops of the articles. The clamping types of load stabilizers often require complex forms of attachment to the existing lift carriage and the connection of operating cylinders and controls to the existing hydraulic systems of the lift trucks on which they are mounted.

Because of the complexity of installation of such stabilizers on fork lift trucks, frequent mounting and removing is not convenient. Such stabilizers may interfere with the use of a forklift truck for general purpose article handling. Because of these factors and, additionally, the expense of such clamping types of load stabilizers, they are often only justifiable economically when there is a high volume of articles requiring special handling. Finally, clamping type load stabilizers are not appropriate for some types of articles and may, in fact, be damaging thereto.

The handling of tall and top-heavy articles would benefit from a load stabilizer apparatus which is relatively simple and inexpensive in construction, which is simple to install on a conventional type of forklift truck with minimal modification thereto, and which is simple to deploy and stow.

SUMMARY OF THE INVENTION

The present invention provides a load stabilizer apparatus for a forklift truck mast which is particularly useful in stabilizing tall and top-heavy articles carried by forklift trucks. The load stabilizer of the present invention generally includes a mounting member connected to a crossbar of the lift mast of a forklift truck, a laterally extending stabilizer frame member hingedly connected to the mounting member for pivoting between a stowed position and a stabilizing position, a retainer latch to retain the stabilizer frame member in the stabilizing position, a pair of stabilizer arms projecting from the stabilizer frame member, and load engaging pads mounted on the ends of the stabilizer arms, each of the pads being pivotable about at least one axis to engage a wide range of load shapes.

More particularly, the mounting member is a laterally extending mounting angle with a mounting web secured to a cross member of the lift carriage of the lift mast and with a hinge flange depending from the mounting web. The stabilizer frame member is also a laterally extending angle member with a stabilizer web having a stabilizer flange intersecting at a stabilizer corner. Hinge components are mounted on an inside surface of the depending flange of the mounting member and on the stabilizer web to form a hinge axis near the lower edge of the depending flange and near the corner of the stabilizer member. The stabilizer arms are tubular members having inner ends secured to the stabilizer flange and have the load engaging pads connected to the outer ends by pivot means such as bolts or pivot pins to allow pivoting thereof.

In the stabilizing position of the stabilizer member, the stabilizer flange projects upward from the stabilizer web and has a latch edge extending above the plane of the upper surface of the mounting web. A latch pawl is pivotally connected to the upper surface of the mounting web and has a notch formed in a lower edge thereof. A front end of the pawl has a mitered edge which is engaged by the latch edge of the stabilizer flange, as the stabilizer member is pivoted toward the stabilizing position, whereby the pawl is pivoted upward to receive the latch edge in the notch of the pawl. The pawl is thereafter pivoted upward to release the latch edge of the stabilizer flange for pivoting the stabilizer frame member back to the stowed position. The stabilizer web preferably has a swing control bumper member extending rearwardly therefrom to engage a lower surface of the cross member of the lift carriage to prevent the stabilizer arms from engaging mechanisms within the lift carriage, such as lift chains, hydraulic lines, or the like.

OBJECTS AND ADVANTAGES OF THE INVENTION

The principal objects of the present invention are: to provide an improved stabilizer apparatus for relatively tall loads handled by forklift trucks and the like; to provide such an apparatus which can be selectively deployed to stabilize a tall or top heavy load and stowed or retracted to allow the forklift truck to be used for general purpose load handling; to provide such an apparatus in which a preferred embodiment does not require connection to the hydraulic system of the forklift vehicle but which could, alternatively, be adapted for hydraulic or electrical extension and retraction; to provide such an apparatus which does not require significant modifications to the structure of the forklift vehicle and which is preferably permanently mounted on the forklift truck, but which could also be modified for temporary mounting; to provide such an apparatus which generally includes a lateral mounting member attached to a cross brace of the lift frame or carriage of a forklift vehicle, a laterally extending stabilizer frame member hingedly connected to the mounting member to enable pivoting between a retracted or stowed position and an extended or load stabilizing position, a pair of laterally spaced parallel stabilizer arms or rods extending from the stabilizer frame member, pads on the outer ends of the stabilizer arms which are pivotable about at least one axis to engage loads having a variety of shapes, and a retainer or latch mechanism to releasably retain the stabilizer in the stabilizing position; to provide such an apparatus which can be retrofitted to a wide variety of forklift vehicles or provided on newly manufactured models thereof; and to provide such a stowable load stabilizer for forklift masts which is economical to manufacture, which is convenient in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
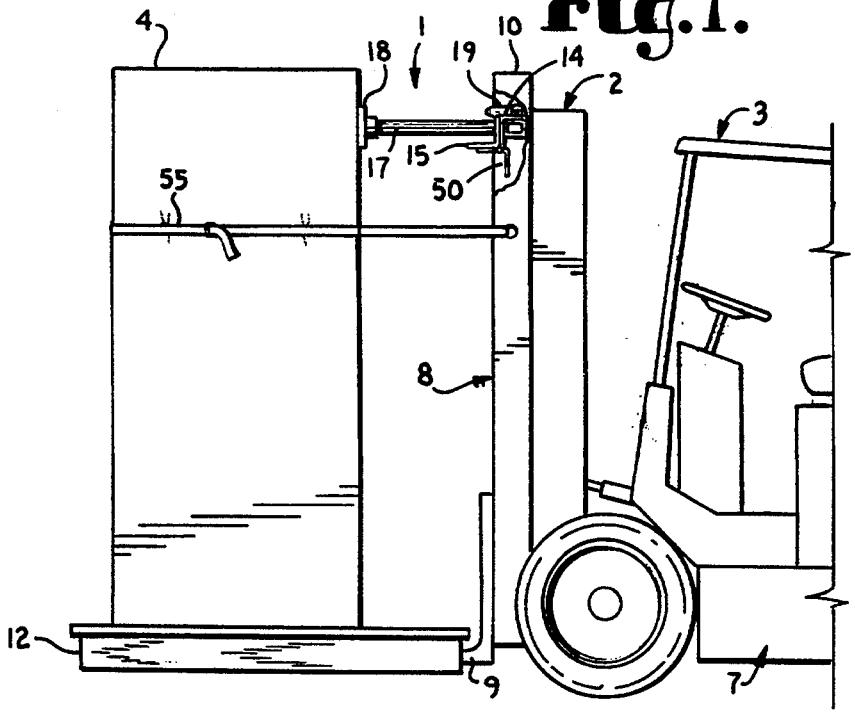
FIG. 1 is a fragmentary side elevational view of a forklift truck incorporating a stowable load stabilizer which embodies the present invention, with a portion of the lift carriage of the truck broken away to show the mounting of the stabilizer.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
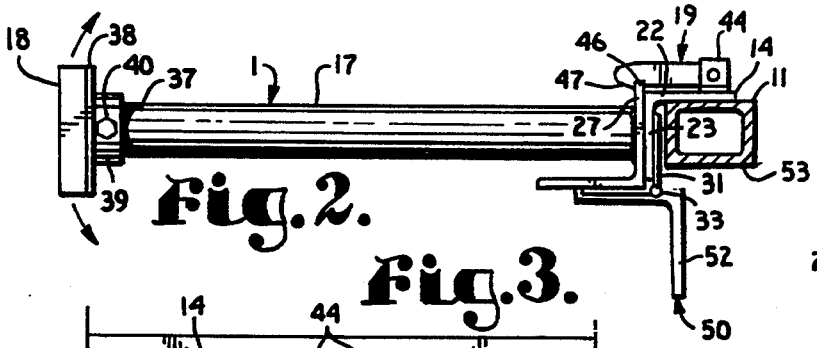
FIG. 2 is an enlarged fragmentary side elevational view of the load stabilizer shown in a deployed, load stabilizing position.
Figure 3:
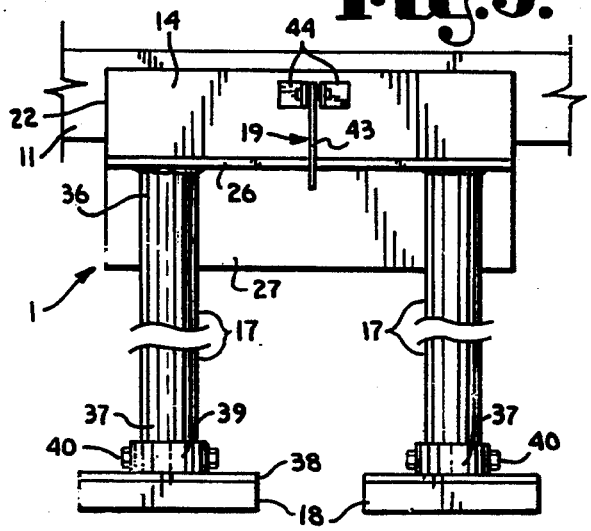
FIG. 3 is a fragmentary top plan view showing the load stabilizer in the deployed position.
Figure 4:
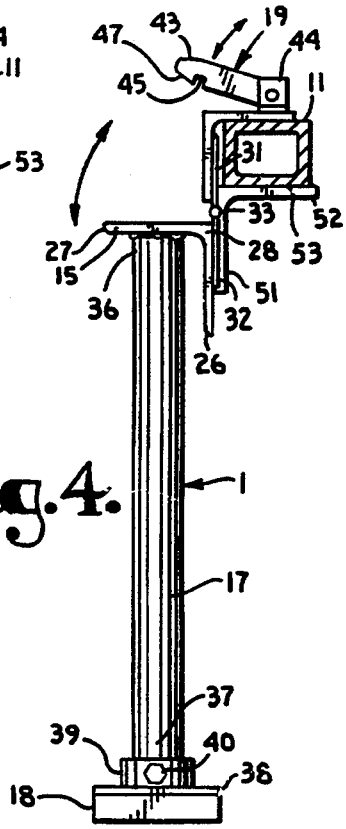
FIG. 4 is a view similar to FIG. 2 and illustrates the load stabilizer in a retracted, stowed position.

Referring to the drawings in more detail:

The reference numeral 1 generally designates a stowable load stabilizer apparatus for a forklift mast 2 and embodying the present invention. The apparatus 1 is mounted on the mast 2 of a forklift truck 3 to stabilize a tall or tall and top heavy load 4 which is to be lifted and moved by the truck 3. In general, the apparatus 1 is movable to a load stabilizing position, as shown in FIGS. 1–3, or a stowed position, as shown in FIG. 4, to allow use of the forklift truck 3 for general load handling.

The forklift truck 3 is a conventional forklift vehicle including a chassis or frame 7 having the mast or lifting mechanism 2 mounted thereon. The mast 2 has a lift carriage 8 slidably mounted thereon for movement by a lift motor arrangement (not shown) of conventional configuration. The lift carriage 8 has a pair of fork tines or forks 9 mounted thereon which are preferably slidable in a lateral direction to increase the lifting versatility of the truck 3. The lift carriage 8 includes vertical side members 10 connected by cross members 11 to form a load supporting framework. The forklift truck 3 is capable of engaging and lifting loads 4 supported on pallets or skids 12 as well as loads which are not palleted.

The illustrated load stabilizer apparatus 1 is mounted on an upper cross member 11 of the lift carriage 8. A mounting member 14 is connected to the cross member 11 and has a stabilizer frame member 15 connected thereto by a hinge mechanism 16. The stabilizer frame member 15 has a pair of laterally spaced, parallel stabilizer arms 17 extending therefrom which terminate in load engaging pads 18. A releasable retainer mechanism 19 retains the apparatus 1 in the extended or stabilizing position and is released to allow the apparatus 1 to assume the retracted or stowed position.

The illustrated mounting member 14 and stabilizer frame member 15 are formed of angle stock. The mounting member 14 has a mounting web 22 which is secured to the cross member 11, as by welding, bolts, or the like, and a depending flange 23 which extends downward from the mounting web 23 and terminates in a free end 24. The stabilizer frame member 15 has a stabilizer web 26 with a stabilizer flange 27 joined thereto at a corner region 28 of the stabilizer frame member 15.

The hinge mechanism 16 includes an upper hinge plate 31 secured to the depending flange 23 of the mounting member, as by welding, and a lower hinge plate 32 secured to the stabilizer web 26, as by welding. The hinge plates 31 and 32 are pivotally connected at a hinge joint 33 which forms a lateral axis of the apparatus 1 extending along the free end 24 of the depending flange 23 and the corner region 28 of the stabilizer frame member 15.

The stabilizer arms 17 are formed of tubular stock and have inner ends 36 secured to the stabilizer flange 27, as by welding. Although the stabilizer arms 17 are illustrated as being spaced from the stabilizer web 27, they could alternatively be further reinforced by being positioned tangent to the webs 27 and welded thereto. Outer ends 37 of the stabilizer arms 17 have the load engaging pads 18 mounted thereon. The pads 18 are preferably resilient and are attached, as by an adhesive, to back plates 38. The back plates 38 have mounting collars 39 positioned on rear surfaces thereof which are sleeved onto the outer ends 37 of the arms 17. The collars 38 are pivotally secured to the ends 37 of the arms 17 by pivot bolts 40 to allow pivoting of the pads 18 about lateral axes to allow the arms 17 to engage loads 4 of a wider variety of shapes. Although not illustrated, the pads 18 could, alternatively, be connected to the stabilizer arms 17 by means such as ball joints to provide the pads 18 with freedom of movement about two axes.

The retainer mechanism 19 includes a latch pawl 43 which is pivotally connected to a pair of latch brackets 44 mounted on the mounting flange 22 of the mounting member 14. The pawl 43 has a notch 45 formed along a lower edge thereof which is positioned along the pawl 43 to engage an upper edge region 46 of the stabilizer flange 27 to retain the apparatus in the stabilizing position, as shown in FIG. 2. The pawl 43 has a cam surface 47 at a lower front end thereof which is engaged by the edge 46 of the flange 27 as the arms 17 are pivoted from the stowed position to the stabilizing position. Engagement of the edge 46 with the cam surface 47 causes the pawl to ride up onto the edge 46 until the edge 46 engages the notch 45, whereby the apparatus 1 is retained in the stabilizing position. The pawl 43 is thereafter lifted to release the edge 46 from the notch 45 to allow the apparatus 1 to be pivoted back to the stowed position.

The apparatus 1 preferably includes a swing limit 50 to prevent the pads 18 and arms 17 from engaging and, possibly, damaging components within the lift carriage 8 or mast 2, such as lift chains, lift cylinders, hydraulic lines, or the like (not shown). The illustrated swing limit 50 is an angle bracket including a mounting web 51 and a stop flange 52. The mounting web 51 is connected to the stabilizer web 26 at such a location as to position the flange 52 to engage a lower surface 53 of the cross member 11 when the apparatus is in the stowed position.

For use in stabilizing a tall freight article 4 positioned on a palled 12, the apparatus 1 is pivoted to the forwardly extending deployed or stabilizing position, and the load is carefully approached with the lift carriage 8 positioned vertically to position the forks 9 under the pallet 12 until the pads 18 are close to the article 4, such as about one inch between the pads 18 and the article 4. A strap 55 is connected to the side members 10 of the lift carriage 8 and passed around the front of the article 4. The lift carriage 8 is lifted to raise the pallet 12 a short distance from the floor, and the strap is tightened.

The strap 55 and the stabilizer apparatus 1 cooperate to prevent the article 4 from tipping backward and forward as the forklift truck 3 accelerates and brakes. Care must be exercised in turning to the right or left to avoid lateral tipping of the article 4. When the article 4 is at its destination, the lift carriage 8 is lowered to position the pallet 12 on the floor, the strap 55 is released, and the forklift is reversed to withdraw the forks 9 from under the pallet 12. When no more tall articles 4 are to be moved, the load stabilizer apparatus 1 may be stowed by releasing the latch pawl 43 and pivoting the apparatus 1 to the stowed position. The forklift truck 3 may then be used for general purpose article handling with minimal interference by the load stabilizer apparatus 1.

The load stabilizer apparatus 1 has been described and illustrated for use on a forklift truck having a lift carriage 8 which includes the cross member 11 formed of tubular stock of rectangular cross section. Because of variations in the construction of various forklift trucks 3, it is foreseen that some modifications of the mounting member 14 might be required to allow attachment of the mounting member 14 to accommodate the configuration of lift carriage frame members in a particular brand of forklift truck 3. However, such variations are regarded as functional equivalents of the mounting member 14 described and illustrated and are, thus, intended to be encompassed by the present invention.

It is to be understood that while certain forms of the present invention have been illustrated and described herein, it is not to be limited to the specific forms or arrangement of parts described and shown.

What is claimed and desired to be secured by Letters Patent is as follows:

1. A load stabilizer apparatus for stabilizing a load positioned on fork members of a forklift device including a liftable mast frame including a laterally extending cross member, said apparatus comprising:

(a) a stabilizer frame hingedly connected to means on said mast frame to enable pivoting of said stabilizer frame relative to said mast frame about a laterally extending axis between a stowed position and a stabilizing position of said stabilizer frame;

(b) a pair of elongated load stabilizer arms having outer ends and being connected to said stabilizer frame in laterally spaced parallel relation, said arms extending forwardly of said mast frame in said stabilizing position whereby said load rests against said outer ends of said arms upon said load being lifted by said forklift device;

(c) said means on said mast frame includes a laterally extending mounting angle member formed by a rearwardly projecting horizontal leg and a depending leg of said mounting angle member having a lower free end, said horizontal leg being connected to said cross member of said mast frame;

(d) said stabilizer frame includes a laterally extending stabilizer angle member formed by a parallel leg which is oriented parallel to said stabilizer arms and a perpendicular leg which is perpendicular to said arms, said parallel leg and said perpendicular leg intersecting at a corner of said stabilizer angle member; and (e) said stabilizer angle member being hingedly connected to said mounting angle member by hinge means positioned along said lower free end of said depending leg and along said corner of said stabilizer angle member.

2. An apparatus as set forth in claim 1 and including:

(b) retainer means releasably engaged between said stabilizer frame and means on said mast frame to retain said arm in said stabilizing position.

3. An apparatus as set forth in claim 1 wherein said means on said mast frame includes:

(a) a laterally extending mounting member connected to said mast frame, said stabilizer frame being hingedly connected to said mounting member.

4. An apparatus as set forth in claim 1 and including:

(a) an edge region of said perpendicular leg of said stabilizer angle member projecting above a plane of said horizontal leg of said mounting angle member in said stabilizing position of said stabilizer frame; and (b) a retainer pawl pivotally connected to said horizontal leg of said mounting angle member and includes a notch positioned thereon to receive said edge region of said perpendicular leg of said stabilizer angle member in said stabilizing position of said stabilizer frame to thereby retain said stabilizer frame in said stabilizing position.

5. An apparatus as set forth in claim 4 wherein said retainer pawl includes:

(a) a cam surface positioned on said pawl to be engaged by said edge region of said perpendicular leg when said stabilizer frame is pivoted toward said stabilizing position to thereby lift said pawl for engagement of said edge region with said notch.

6. An apparatus as set forth in claim 1 and including:

(a) swing control means connected to said stabilizer frame and positioned to engage means on said mast frame in said stowed position of said stabilizer frame to thereby prevent said arms from swinging past a selected angle with respect to said mast frame.

7. An apparatus as set forth in claim 1 and including:

(a) pad means connected to each of said outer ends of said arms to enable movement of said pad means about at least one axis to facilitate engagement of said arms with said load.

8. A load stabilizer apparatus for stabilizing a relatively tall load positioned on form members of a forklift device including a liftable mast frame with a laterally extending cross member positioned on an upper portion of said mast frame, said apparatus comprising:

(a) a laterally extending mounting angle member formed by a rearwardly projecting horizontal leg and a depending leg of said mounting angle member having a lower free end, said horizontal leg being connected to said cross member of said mast frame;

(b) a laterally extending stabilizer angle member formed by a parallel leg and a perpendicular leg which is perpendicular to said parallel leg, said parallel leg and said perpendicular leg intersecting at a corner of said stabilizer angle member;

(c) said stabilizer angle member being hingedly connected to said mounting angle member by hinge means positioned along said lower free end of said depending leg and along said corner of said stabilizer angle member to enable pivoting said stabilizer angle member between a stowed position and a stabilizing position;

(d) a pair of elongated load stabilizer arms having outer ends and having inner ends connected to said stabilizer angle member in laterally spaced parallel relation, said arms extending forwardly of said mast frame in said stabilizing position whereby an upper portion of said relatively tall load rests against said outer ends of said arms upon said load being lifted by said fork members of said forklift device;

(e) retainer means releasably engaged between said mounting angle member and said stabilizer angle member to retain said stabilizer angle member in said stabilizing position.

9. An apparatus as set forth in claim 8 and including:

(a) an edge region of said perpendicular leg of said stabilizer angle member projecting above a plane of said horizontal leg of said mounting angle member in said stabilizing position of said stabilizer frame; and (b) said retainer means including a retainer pawl pivotally connected to said horizontal leg of said mounting angle member and includes a notch positioned thereon to receive said edge region of said perpendicular leg of said stabilizer angle member in said stabilizing position of said stabilizer frame to thereby retain said stabilizer frame in said stabilizing position.

10. An apparatus as set forth in claim 9 wherein said retainer pawl includes:

(a) a cam surface positioned on said pawl to be engaged by said edge region of said perpendicular leg when said stabilizer frame is pivoted toward said stabilizing position to thereby lift said pawl for engagement of said edge region with said notch.

11. An apparatus as set forth in claim 8 and including:

(a) swing control means connected to said stabilizer angle member and positioned to engage said cross member of said mast frame in said stowed position of said stabilizer angle member to thereby prevent said arms from swinging past a selected angle with respect to said mast frame.

12. An apparatus as set forth in claim 8 and including:

(a) pad means connected to each of said outer ends of said arms to enable movement of said pad means about at least one axis to facilitate engagement of said arms with said load.

13. A load stabilizer apparatus for stabilizing a relatively tall load positioned on fork members of a forklift device including a liftable mast frame with a laterally extending cross member positioned on an upper portion of said mast frame, said apparatus comprising:

(a) a laterally extending mounting angle member formed by a rearwardly projecting horizontal leg and a depending leg of said mounting angle member having a lower free end, said horizontal leg being connected to said cross member of said mast frame;

(b) a laterally extending stabilizer angle member formed by a parallel leg and a perpendicular leg which is perpendicular to said parallel leg, said parallel leg and said perpendicular leg intersecting at a corner of said stabilizer angle member;

(c) said stabilizer angle member being hingedly connected to said mounting angle member by hinge means positioned along said lower free end of said depending leg and along said corner of said stabilizer angle member to enable pivoting said stabilizer angle member between a stowed position and a stabilizing position;

(d) an edge region of said perpendicular leg of said stabilizer angle member projecting above a plane of said horizontal leg of said mounting angle member in said stabilizing position of said stabilizer frame;

(e) a pair of elongated load stabilizer arms having outer ends and having inner end connected to said stabilizer angle member in laterally spaced parallel relation, said arms extending forwardly of said mast frame in said stabilizing position whereby an upper portion of said relatively tall load rests against said outer ends of said arms upon said load being lifted by said fork members of said forklift device;

(f) pad means connected to each of said outer ends of said arms to enable movement of said pad means about at least one axis to facilitate engagement of said arms with said load;

(g) retainer means releasably engaged between said mounting angle member and said stabilizer angle member to retain said stabilizer angle member in said stabilizing position, said retainer means including:

(1) a retainer pawl pivotally connected to said horizontal leg of said mounting member and including a notch positioned thereon to receive said edge region of said perpendicular leg of said stabilizer angle member in said stabilizing position of said stabilizer frame to thereby retain said stabilizer frame in said stabilizing position; and (2) a cam surface positioned on said pawl to be engaged by said edge region of said perpendicular leg when said stabilizer frame is pivoted toward said stabilizing position to thereby lift said pawl for engagement of said edge region with said notch; and (h) swing control means connected to said stabilizer angle member and positioned to engage said cross member to said mast frame in said stowed position of said stabilizer angle member to thereby prevent said arms from swinging past a selected angle with respect to said mast frame.

* * * * *